US009357897B2

(12) United States Patent
Estep

(10) Patent No.: US 9,357,897 B2
(45) Date of Patent: Jun. 7, 2016

(54) HANDS-FREE POT SCRUBBER

(71) Applicant: Brent McNair Estep, San Diego, CA (US)

(72) Inventor: Brent McNair Estep, San Diego, CA (US)

( * ) Notice: Subject to any disclaimer, the term of this patent is extended or adjusted under 35 U.S.C. 154(b) by 484 days.

(21) Appl. No.: 13/794,632

(22) Filed: Mar. 11, 2013

(65) Prior Publication Data

US 2013/0269127 A1 Oct. 17, 2013

Related U.S. Application Data

(63) Continuation-in-part of application No. 12/714,564, filed on Mar. 1, 2010, now Pat. No. 8,413,283.

(60) Provisional application No. 61/156,489, filed on Feb. 28, 2009.

(51) Int. Cl.

| | |
|---|---|
| ***A47L 15/37*** | (2006.01) |
| ***A46B 5/00*** | (2006.01) |
| ***A46B 13/00*** | (2006.01) |
| ***A46B 13/02*** | (2006.01) |
| ***A47L 17/04*** | (2006.01) |

(52) U.S. Cl.

CPC ..... *A47L 15/37* (2013.01); *A46B 5/0012* (2013.01); *A46B 13/008* (2013.01); *A46B 13/02* (2013.01); *A47L 17/04* (2013.01); *A46B 2200/3006* (2013.01); *A46B 2200/3033* (2013.01)

(58) Field of Classification Search

CPC ..... B08B 1/04; B08B 1/00; A46B 13/02; A47L 15/37; A47K 7/04; A47K 7/026

See application file for complete search history.

(56) References Cited

U.S. PATENT DOCUMENTS

| | | | | |
|---|---|---|---|---|
| 3,444,576 | A * | 5/1969 | Daane | 15/28 |
| 3,715,770 | A | 2/1973 | Obregon-Gomez | |
| 3,864,779 | A | 2/1975 | Thomas | |
| 3,947,909 | A | 4/1976 | Kuo | |
| D245,948 | S * | 10/1977 | Wolff | D4/102 |
| 4,060,871 | A | 12/1977 | Bryerton | |
| 4,062,082 | A | 12/1977 | Azzopardi | |
| 4,158,246 | A * | 6/1979 | Meadows et al. | 15/28 |
| 4,223,418 | A | 9/1980 | Pedrini | |
| 5,279,672 | A | 1/1994 | Betker et al. | |
| 5,450,646 | A | 9/1995 | McHugh et al. | |
| 5,720,395 | A | 2/1998 | Schock et al. | |
| 5,956,792 | A | 9/1999 | Gutelius et al. | |
| 6,704,965 | B2 | 3/2004 | Ale et al. | |
| 7,363,673 | B2 * | 4/2008 | Schonewille et al. | 15/29 |
| 7,507,296 | B2 | 3/2009 | Sugarman et al. | |
| 7,765,638 | B2 | 8/2010 | Pineschi et al. | |
| 7,837,958 | B2 | 11/2010 | Crapser et al. | |
| 8,413,283 | B1 * | 4/2013 | Estep | 15/29 |
| 2004/0123410 | A1 | 7/2004 | Terry et al. | |

FOREIGN PATENT DOCUMENTS

| | | |
|---|---|---|
| GB | 2141620 A | 1/1985 |

* cited by examiner

*Primary Examiner* — Robert Scruggs

(74) *Attorney, Agent, or Firm* — Andover Patents, LLC; Daniel N. Beinart

(57) ABSTRACT

A portable, hands-free device for cleaning a cooking utensil includes a motor, a source of electrical power electrically coupled to the motor, and scrub brushes mechanically coupled to the motor.

11 Claims, 21 Drawing Sheets

HANDS-FREE POT SCRUBBER

CROSS-REFERENCE TO RELATED APPLICATIONS

This non-provisional application is a continuation-in-part application of U.S. Non-Provisional application Ser. No. 12/714,564 filed Mar. 1, 2010 and entitled "Hands-free Pot Scrubber", the entire contents of which are hereby incorporated by reference, as if fully set forth herein.

This non-provisional claims the benefit of priority to the U.S. Provisional Application Ser. No. 61/156,489 filed Feb. 28, 2009 and entitled "Hands-free Pot Scrubber", the entire contents of which are hereby incorporated by reference, as if fully set forth herein.

FIELD OF THE INVENTION

The present invention relates generally to the field of motorized cleaning devices, and more particularly to a hands-free device that is used to clean pots, pans and other cookware, from here on to be described as cooking utensils.

BACKGROUND OF THE INVENTION

Existing devices for cleaning cooking utensils have various deficiencies. For example, some must be fixed in place (e.g., a dishwasher), and therefore, a cooking utensil must be brought to the device for cleaning, rather than vice-versa. In addition, a dishwasher is not capable of adequately cleaning certain cooking utensils, e.g., pots with burned food or grease residue. Other existing devices for cleaning cooking utensils are not fixed in place (e.g., a Black & Decker Powered Scrubber), but these devices have the drawback of requiring a user to hold and guide the device in its operation, rather than permitting a user to use the device in a hands-free fashion.

Therefore a need exists for a device that permits the cleaning of cooking utensils without the user holding on to the device or the cooking utensil. Furthermore, a need exists for a device for cleaning cooking utensils that permits an operator to attend to other activities during its operation.

A device constructed according to the principles of the present invention addresses these deficiencies.

BRIEF SUMMARY OF THE INVENTION

In accordance with principles of the present invention, one embodiment of a hands-free portable device for cleaning a surface includes one or more motors, and at least two scrub brushes rotationally coupled to the motors, wherein the distribution of mass of the hands-free device is substantially uneven. Motion from the motors is rotationally transferred to the scrub brushes. The transferred motion and the uneven distribution of mass of the hands-free pot scrubber cause the device to be self-propelled on the surface.

In accordance with principles of the present invention, another embodiment of a hands-free portable device for cleaning a surface includes one or more motors, an assembly including at least one first scrub brush rotationally coupled to the motors, a hinged portion coupled to the assembly by at least one hinge, and at least one second scrub brush rotationally coupled to the hinged portion and mechanically coupled to at least one of the motors. Motion from the motors is rotationally transferred to the scrub brushes. The transferred motion causes the device to be self-propelled on the surface.

In accordance with principles of the present invention, another embodiment of a hands-free portable device for cleaning a surface includes one or more motors, an assembly including at least one scrub brush rotationally coupled to the motors, a hinged portion coupled to the assembly by at least one hinge, and at least one wheel rotationally coupled to the hinged portion. Motion from the motors is rotationally transferred to the scrub brushes. The transferred motion causes the device to be self-propelled on the surface.

Figure 1:
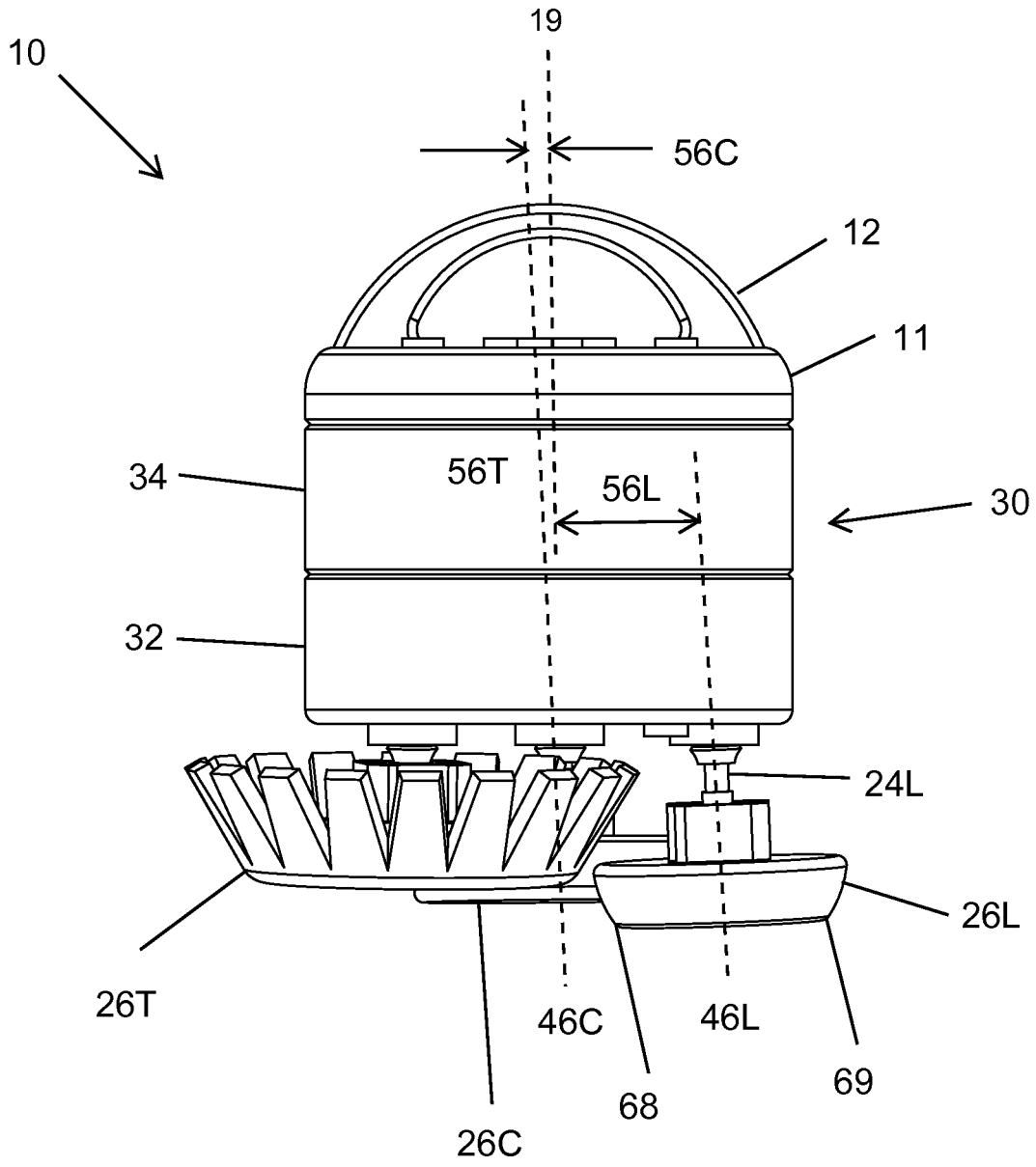
FIGS. 1-3 depict a front, side, and perspective view, respectively, of a first embodiment of a hands-free pot scrubber in accordance with principles of the present invention.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION OF THE INVENTION

FIGS. 1-8 depict a first embodiment of a portable hands-free pot scrubber in accordance with principles of the present invention. The hands-free pot scrubber 10 comprises a cover 11 having a handle 12, base section 32, top section 34, drive gear 17, rod gears 16, drive chain 18, motor 20, motor shaft 21, batteries 22, switch 23, drive members or rods 24 (also referred to as shafts), scrub brush mounts 25, scrub brushes 26, and electrical conductors (not shown), e.g., wires, electrically connecting the batteries 22, the switch 23 and the motor 20.

Figure 4:
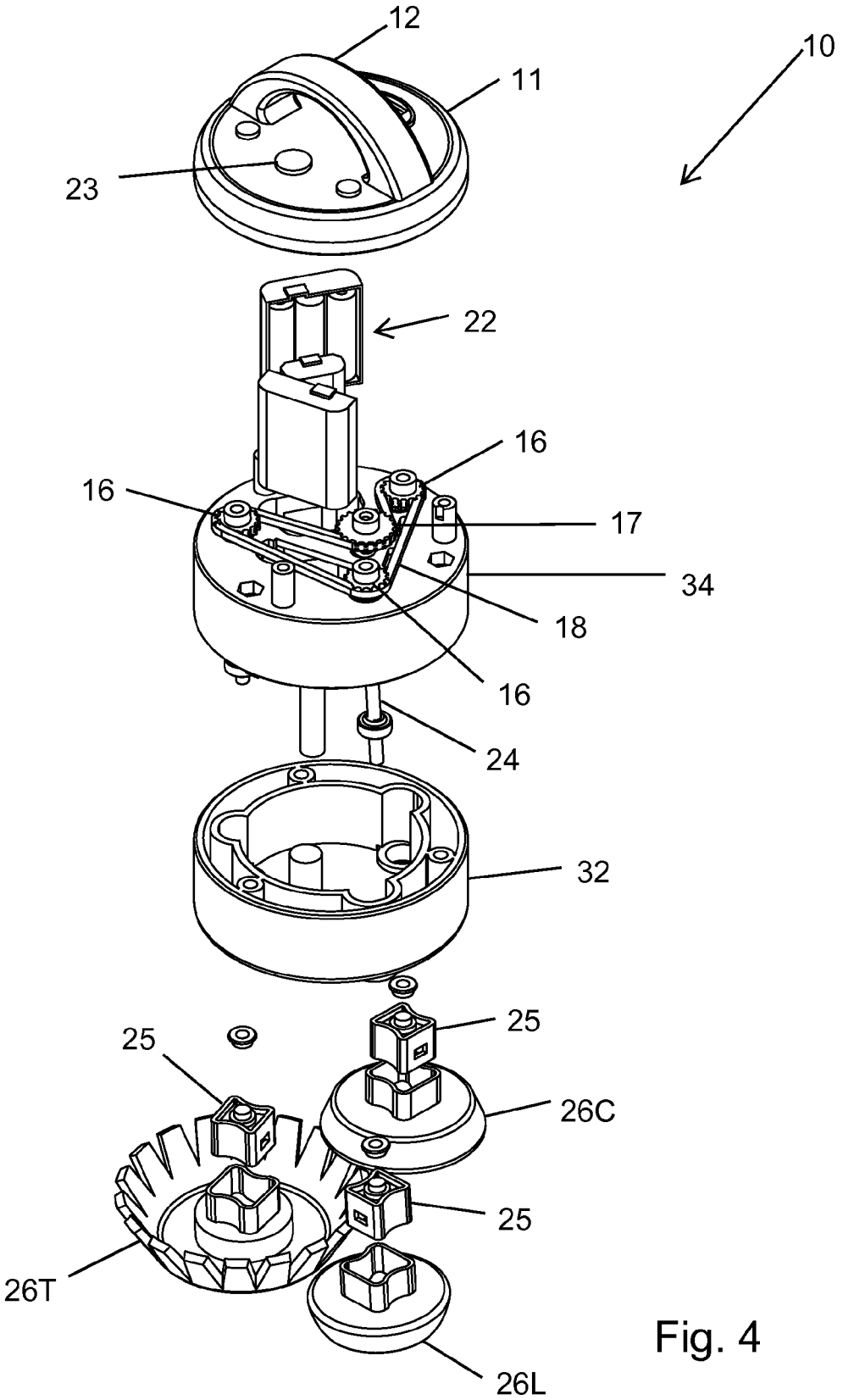
FIG. 4 is an exploded view of the hands-free pot scrubber depicted in FIG. 1.

The cover 11, top section 34 and base section 32 are assembled to fit together as depicted in FIG. 4, thus forming a substantially waterproof housing 30 and substantially rigid frame for the support of other components of the hands-free pot scrubber 10. When assembled, the drive rods 24 extend through matching openings in the base section 32, and the scrub brush mounts 25 are attached to the drive rods 24. The scrub brushes 26 are attached to the scrub brush mounts 25. While the scrub brushes 26 depicted in FIGS. 1-8 are each substantially circular with non-equal diameters, one skilled in the art will recognize that two or more of the scrub brushes 26 may have substantially equal diameters. Furthermore, a scrub brush 26 may alternatively be of non-circular shape, e.g., rectangular.

Figure 2:
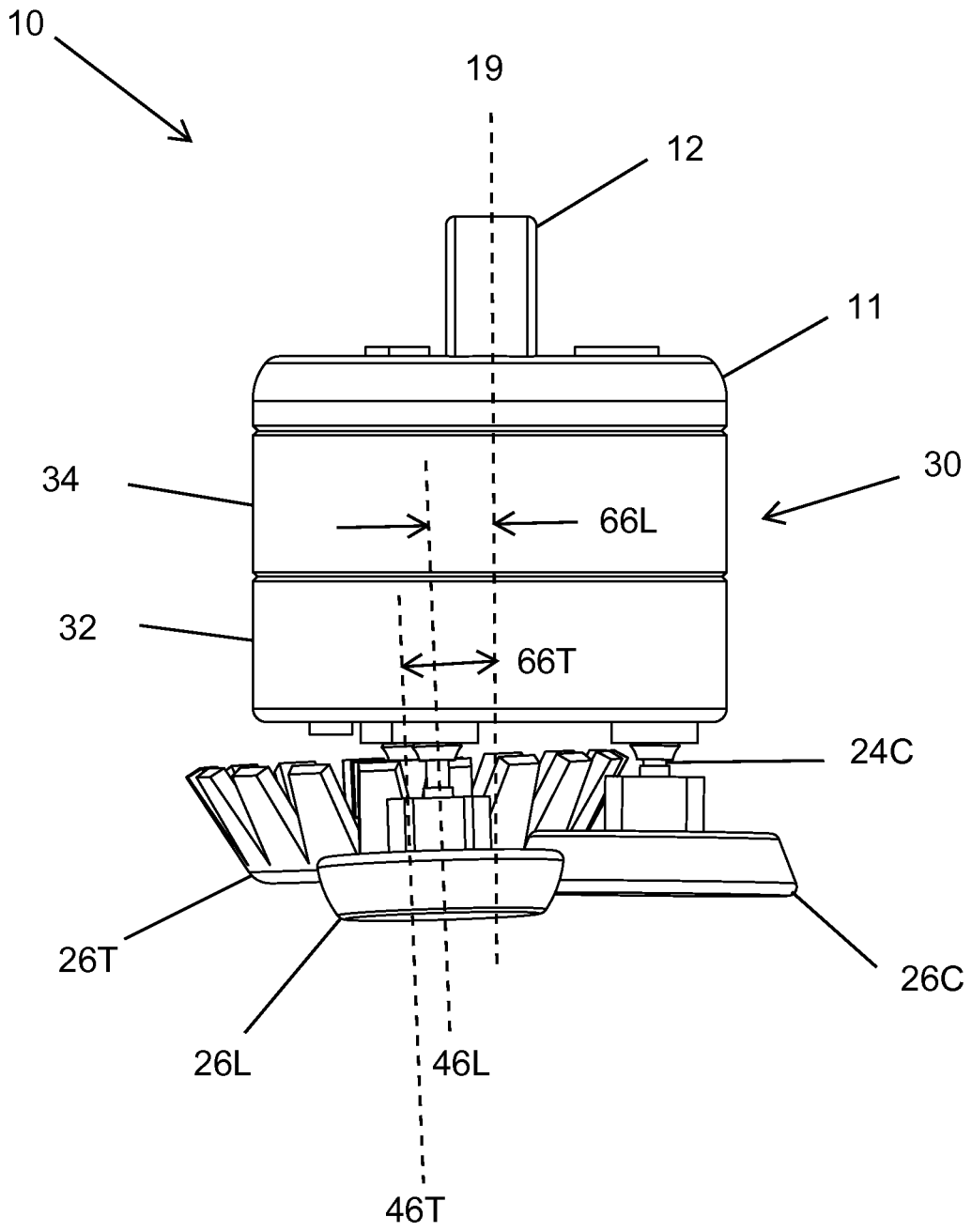
Figure 3:
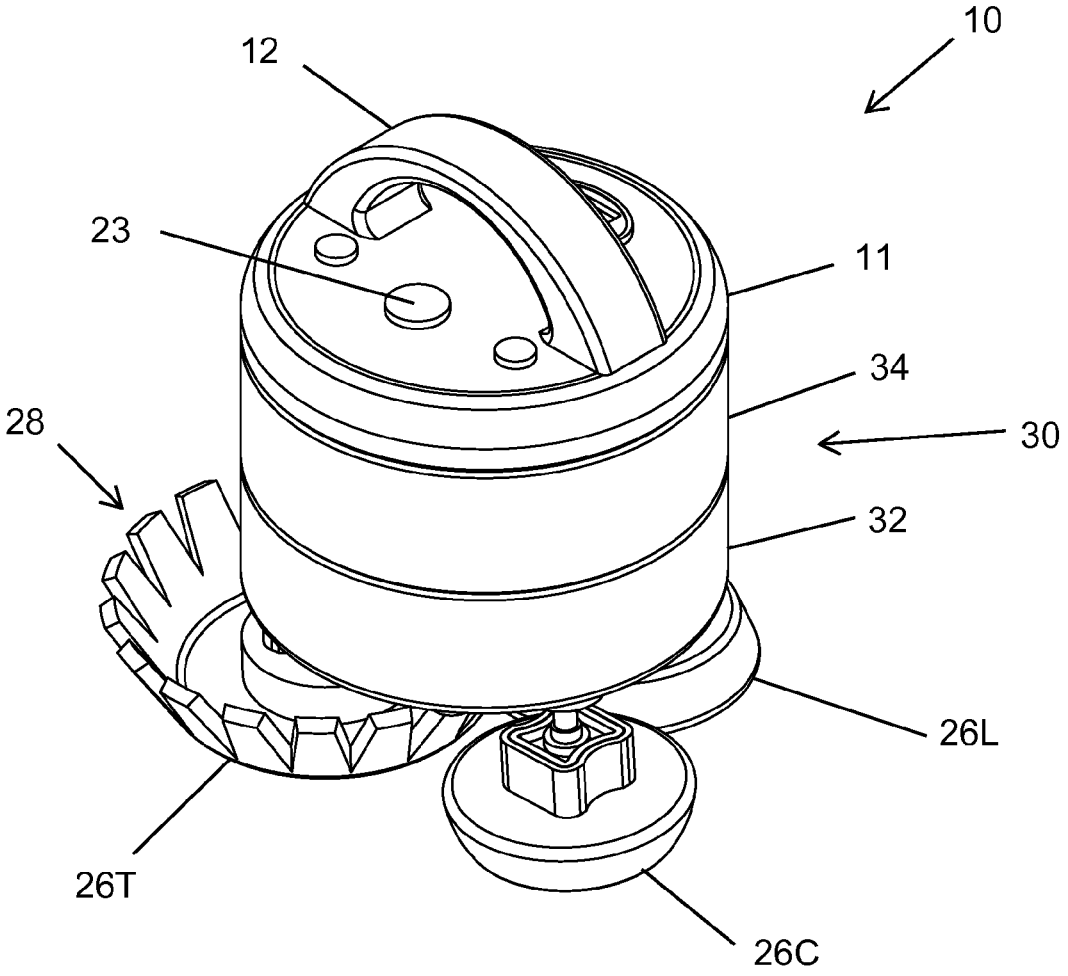
Figure 5:
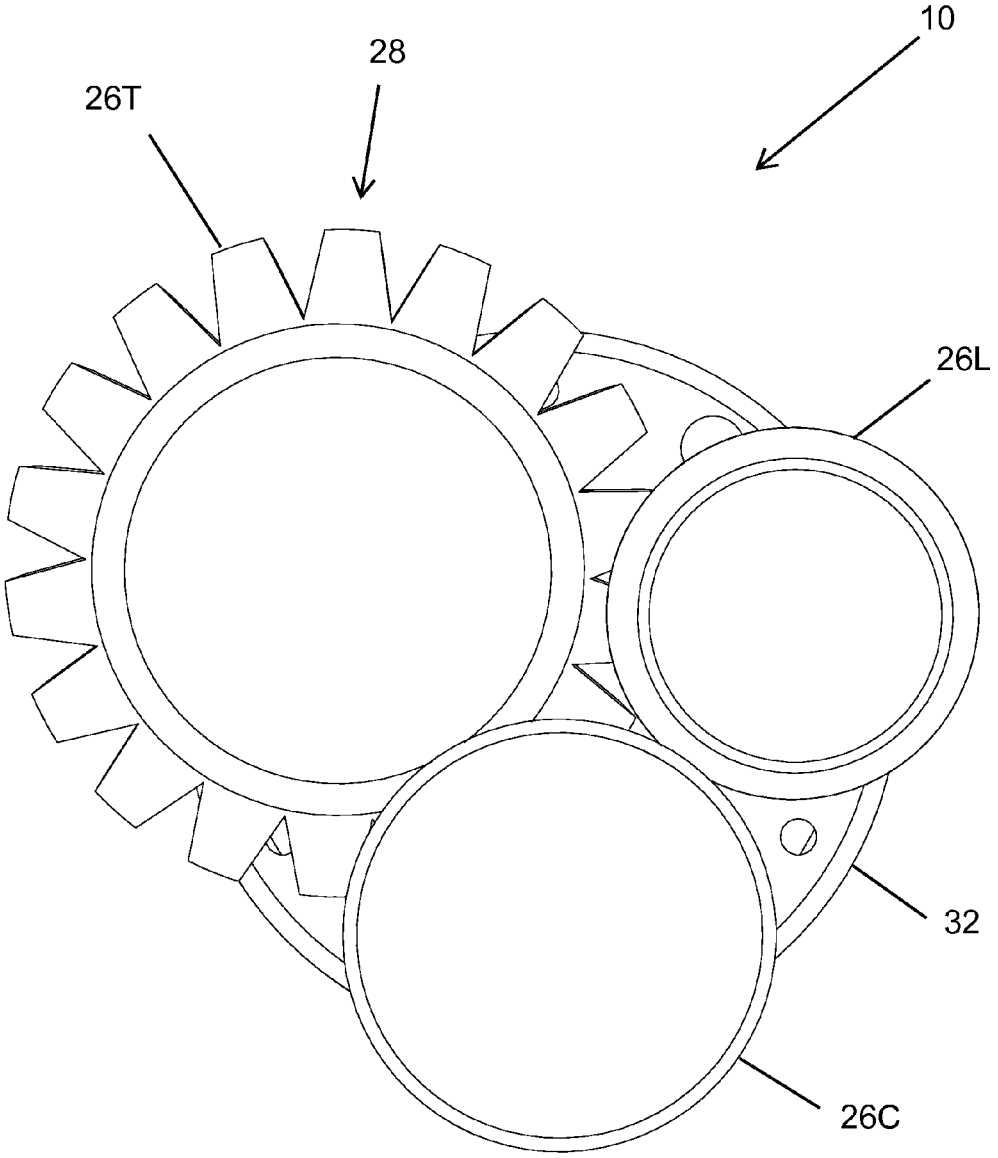
FIG. 5 is a view of the bottom of the hands-free pot scrubber depicted in FIG. 1.
Figure 6:
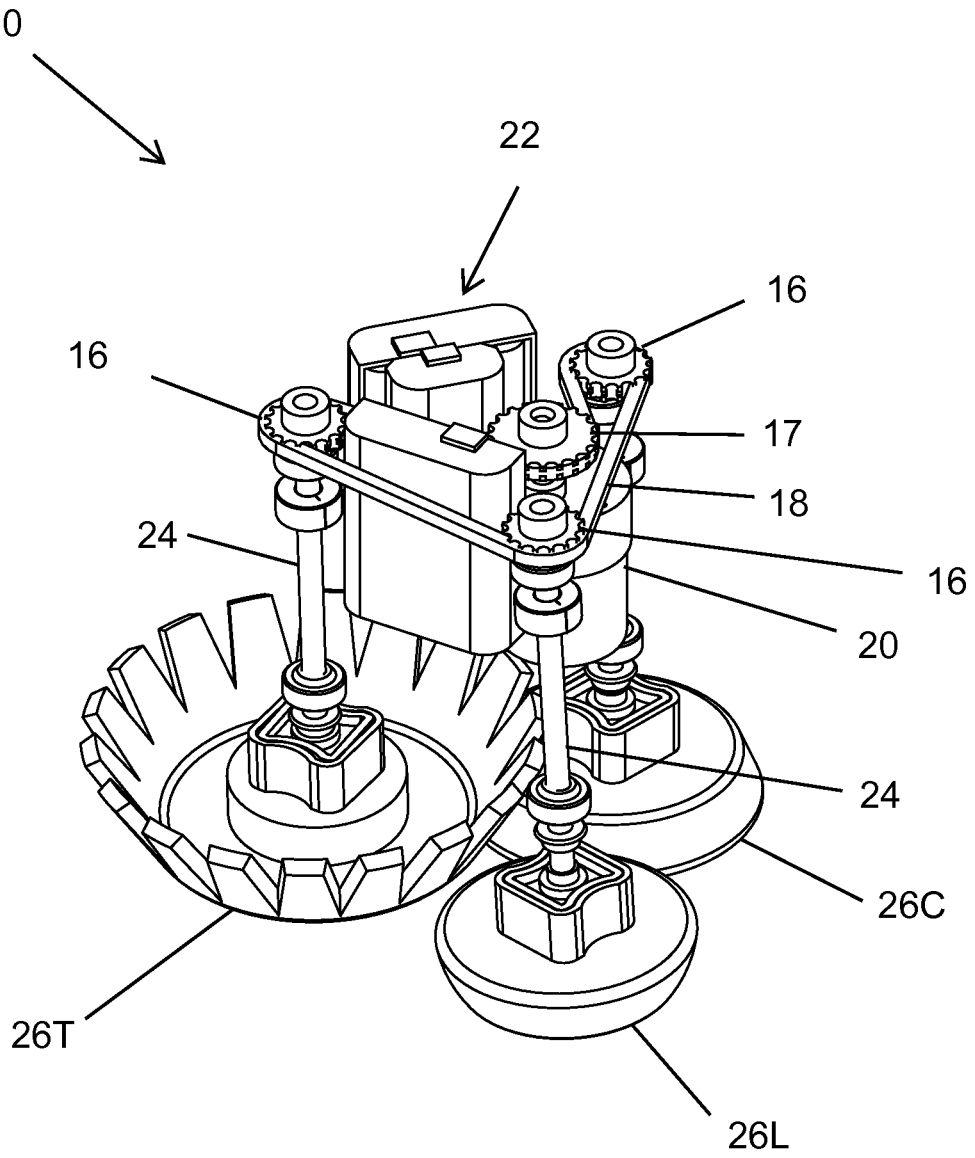
FIG. 6 is a view of components of the hands-free pot scrubber depicted in FIG. 1 without a housing.
Figure 7:
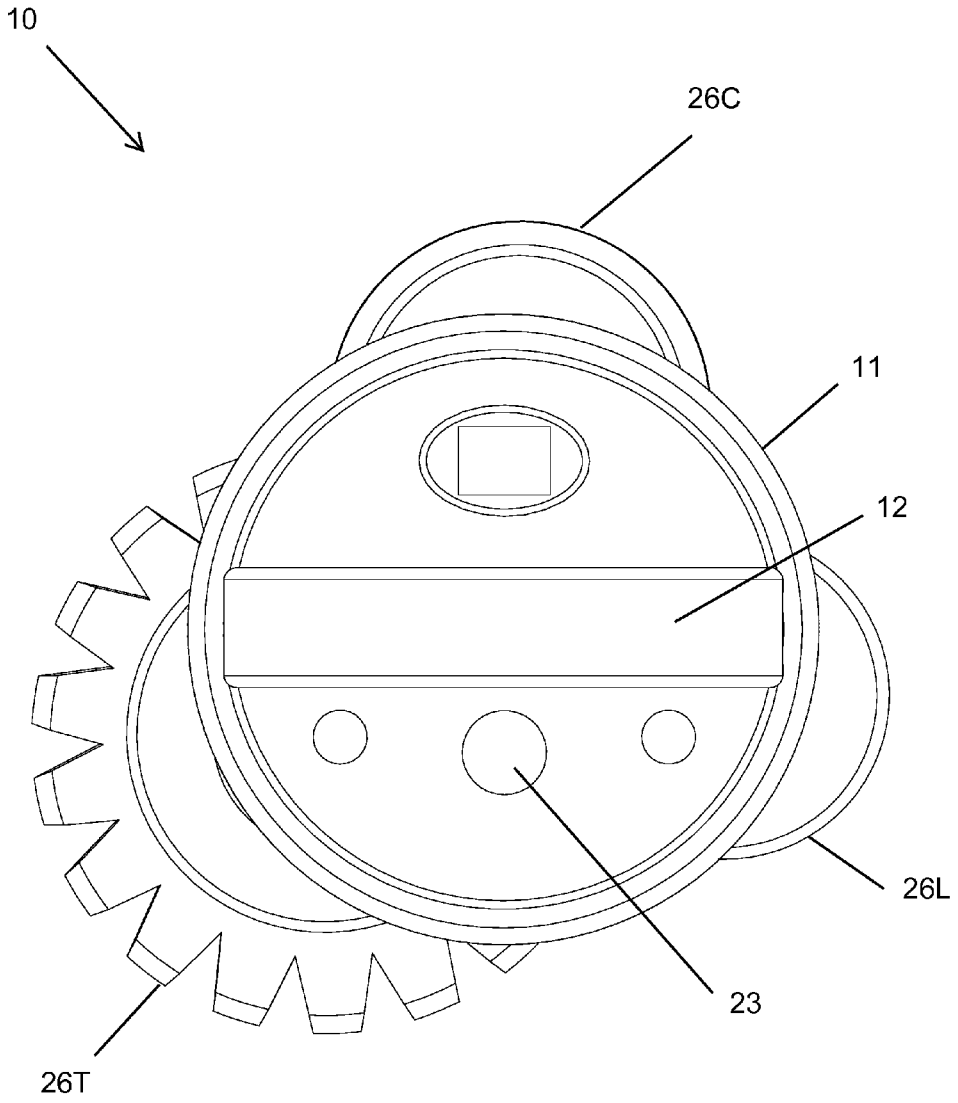
FIG. 7 is a top view of the hands-free pot scrubber depicted in FIG. 1.
Figure 8:
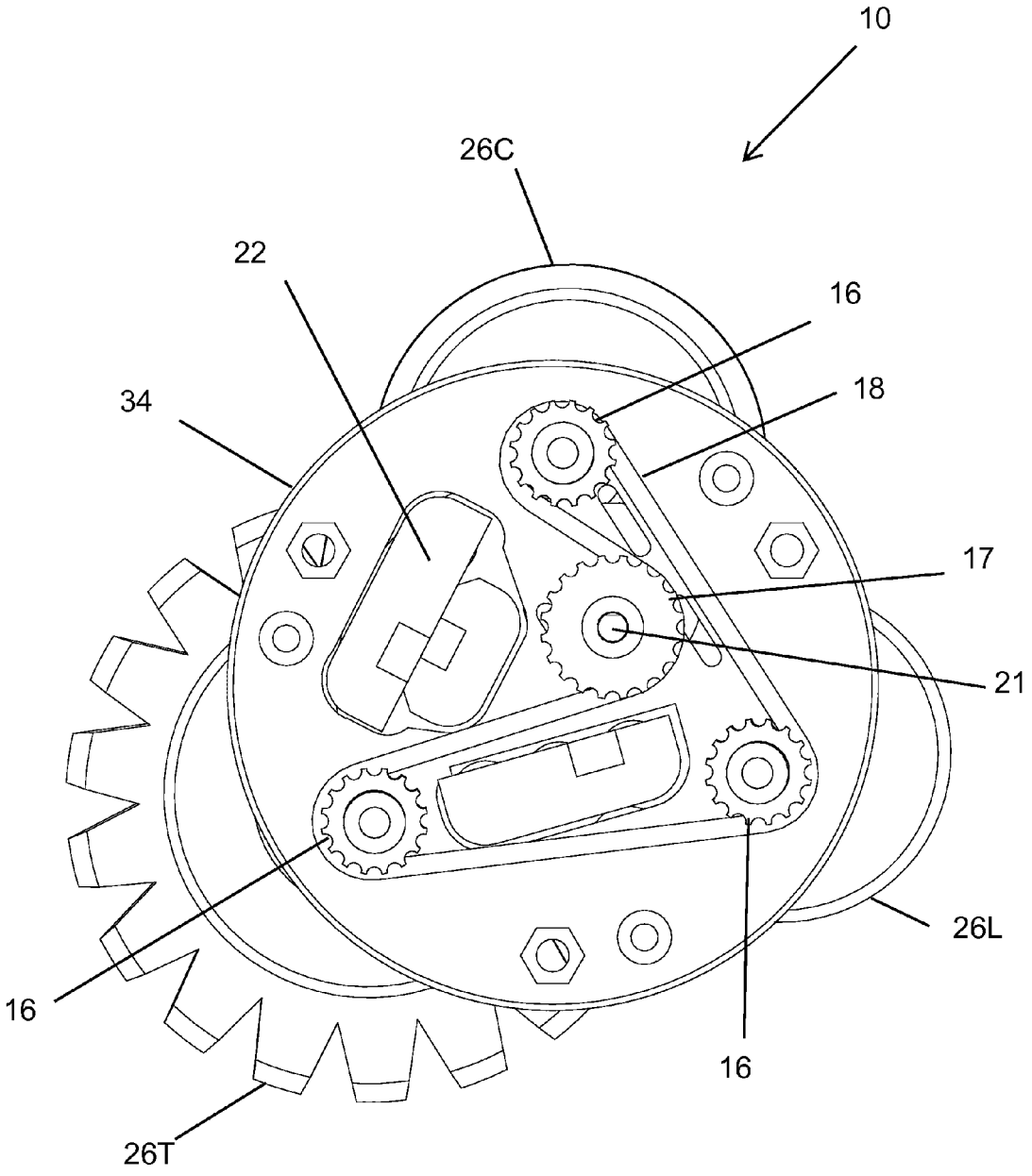
FIG. 8 is a top view without a cover of the hands-free pot scrubber depicted in FIG. 1.

As depicted in FIGS. 1-2, a central axis 19 of a hands-free pot scrubber 10 is disposed substantially in the center of the pot scrubber 10, aligned substantially vertically when the hands-free pot scrubber 10 is placed in an operational position on top of a substantially horizontal cooking utensil surface or food preparation surface. Furthermore, as depicted in FIG. 5, the scrub brushes 26 are arranged asymmetrically around the central axis 19.

The junctions of the cover 11, top section 34 and base section 32 may be sealed to prevent water penetration, e.g., with one or more O-rings. In addition, the drive rods 24 may be sealed, e.g., with sealed spherical bearings, stainless steel or composite spherical bearings and separate rubber shaft seals.

One skilled in the art will recognize that the batteries 22 may be a single battery, a plurality of batteries or a battery pack comprised of a plurality of batteries. Furthermore, the batteries 22 may be single-use or rechargeable. In some embodiments, the batteries 22 may be any suitable source of electrical power, e.g., one based on lead-acid, alkaline, lithium-ion, nickel metal hydride or capacitive technology.

A hands-free pot scrubber 10 may also include additional components (not shown): a soap dispenser (either manual or automatic) for release of soap (or other cleaning liquid) during operation.

In operation, a hands-free pot scrubber 10 is placed on top of a substantially horizontal surface of a cooking utensil to be cleaned. Water and soap are typically placed within the cooking utensil. When a user is ready to operate the hands-free pot scrubber 10, he or she operates the switch 23. The batteries 22, which are electrically coupled to the switch 23 and motor 20 by electrical conductors as described above, power the motor 20 after the user operates the switch 23. The drive gear 17 is attached to the motor shaft 21 and is fitted with the drive chain 18, which in turn threads around each of the rod gears 16. Each rod gear 16 and scrub brush 26 is attached to the top and bottom end, respectively, of a drive rod 24. Thus, the motor 20 is mechanically coupled to the motor shaft 21, drive gear 17, drive chain 18, rod gears 16, drive rods 24, scrub brush mounts 25, and scrub brushes 26. When the motor 20 is powered, the motor shaft 21 moves the drive gear 17, which moves the drive chain 18, which in turn causes the rod gears 16, drive rods 24, scrub brush mounts 25 and scrub brushes 26 to rotate, thereby propelling the hands-free pot scrubber 10 across and cleaning the surface of the cooking utensil. Each scrub brush 26 rotates in a substantially circular motion relative to the common axes of rotation of the associated drive rod 24, scrub brush mount 25 and scrub brush 26.

One skilled in the art will recognize that a hands-free pot scrubber 10 may include alternate mechanisms for driving the motion of the scrub brushes 26, e.g., pulleys and a belt rather than gears and a chain, or direct drive of the scrub brushes 26 or the drive rods 24 by one or more motors 20.

One skilled in the art will also recognize that a hands-free pot scrubber 10 may be comprised of more than or less than the three sets of rod gears 16, drive rods 24, scrub brush mounts 25 and scrub brushes 26 depicted in FIGS. 1-8. Furthermore, each of the scrub brushes 26 may each be of a different size as depicted in FIGS. 1-8, or one or more may be substantially of a same size. Additionally, each of the sets of rod gears 16, drive rods 24, scrub brush mounts 25 and scrub brushes 26 may be disposed symmetrically around the axis of motor shaft 21. The lengths of the drive rods 24 may differ or be substantially equal.

In one embodiment of a hands-free device 10, the drive rods 24 (24C, 24L, 24T) are of unequal length. The unequal length of the drive rods 24 places center scrub brush 26C, leading scrub brush 26L and trailing scrub brush 26T at unequal distances relative to the housing 30. The unequal distances of the scrub brushes 26 relative to the housing 30 result in the hands-free device 10 positioned at a tilt relative to a surface upon which it is placed, i.e., the center axis 19 of the hands-free device 10 assumes a non-zero angle with vertical when the hands-free device 10 is placed upon a surface. In other words, the hands-free device 10 is tilted when it is on a level horizontal surface such as the surface of a cooking utensil or food preparation surface.

In some embodiments, the above-described tilt of the hands-free device 10 causes the center of weight of the hands-free device 10 to not be aligned with the center axis 19, which causes unequal portions of the weight of the hands-free device 10 to be borne by the scrubbers 26. In other embodiments, the tilt of the hands-free device 10 causes an unequal compression of at least two of the scrub brushes 26, which results in unequal traction between the surface and at least two scrub brushes 26, which in turn results in greater force applied to the surface by at least one of the scrub brushes 26. In either embodiment, the unequal distances of at least two of the scrub brushes 26 relative to the housing 30 result in the hands-free device 10 propelling itself across and cleaning the surface upon which it is operating.

One skilled in the art will recognize that an embodiment of a hands-free device 10 need not have all of the drive rods 24 of unequal length. For example, if only two drive rods 24 are of unequal length, this will result in the effects described above that will enable a hands-free device 10 to propel itself across a surface. Furthermore, there are suitable arrangements of components that will couple a scrub brush 26 to a motor 20 other than those described above, and any such arrangement that places the scrub brushes 26 at unequal distances relative to the housing 30 will enable the hands-free pot scrubber 10 to self-propel.

In one embodiment of a hands-free pot scrubber 10, the circular motion of the scrub brushes 26 is substantially continuous and of uniform speed when the device is operating. In an alternate embodiment, the scrub brush motion alternates in an oscillatory manner between clockwise and counterclockwise motion. In still a further embodiment, the scrub brush motion is intermittent rather than continuous. In yet a further embodiment, the scrub brush motion is two or more of the following: continuous, oscillatory, or intermittent.

As depicted in the front view of FIG. 1, a lead drive rod 24L and a center drive rod 24C have respective axes 46L and 46C that are each oriented at respective angles 56L and 56C of substantially two degrees each relative to the central axis 19 when viewed from the front. As depicted in the side view of FIG. 2, the axis 46T of trailing drive rod 24T is oriented at an angle 66T of substantially two degrees relative to the central axis 19, and axis 46L of lead drive rod 24L is further oriented at an angle 66L of substantially two degrees relative to the central axis 19, when the hands-free pot scrubber 10 is viewed from the side. In this embodiment of the hands-free pot scrubber 10, any angle between a drive rod 24 and the central axis 19 that is not specified above is substantially zero. One skilled in the art will recognize that rod angles other than two degrees relative to the central axis 19 may be used, and that other combinations of angles other than specified above may be used.

This arrangement of drive rods 24 at non-zero angles relative to the central axis 19 causes the scrub brushes 26 to be disposed at non-zero angles, i.e., tilted, relative to the surface of a cooking utensil. Thus, at any given time, one edge of a scrub brush 26 is either lower relative to the surface of the cooking utensil than its opposite edge, or makes better contact, due to greater compression of the scrub brush 26 at that edge, with the surface of the cooking utensil than its opposite edge. For example, in operation, the edge 68 of lead scrub brush 26L is lower relative to the surface of a cooking utensil than the edge 69 of lead scrub brush 26L. The difference in relative height of the two edges of a scrub brush results in better contact and thus greater traction between the lower edge and the surface of the cooking utensil than between the opposite edge and the surface of the cooking utensil. The difference in traction causes the hands-free pot scrubber 10 to be propelled, due to the force of the rotating scrub brushes 26, across the surface of the cooking utensil in the direction of the higher edge. When lead scrub brush 26L and/or trailing scrub brush 26T make contact with the sidewall of a cooking utensil, the resistance of the sidewall to the motion of the hands-free pot scrubber 10 combined with the rotary motions of the scrubbers 26 cause the hands-free pot scrubber 10 to move circularly around the surface of the cooking utensil.

Figure 9A:
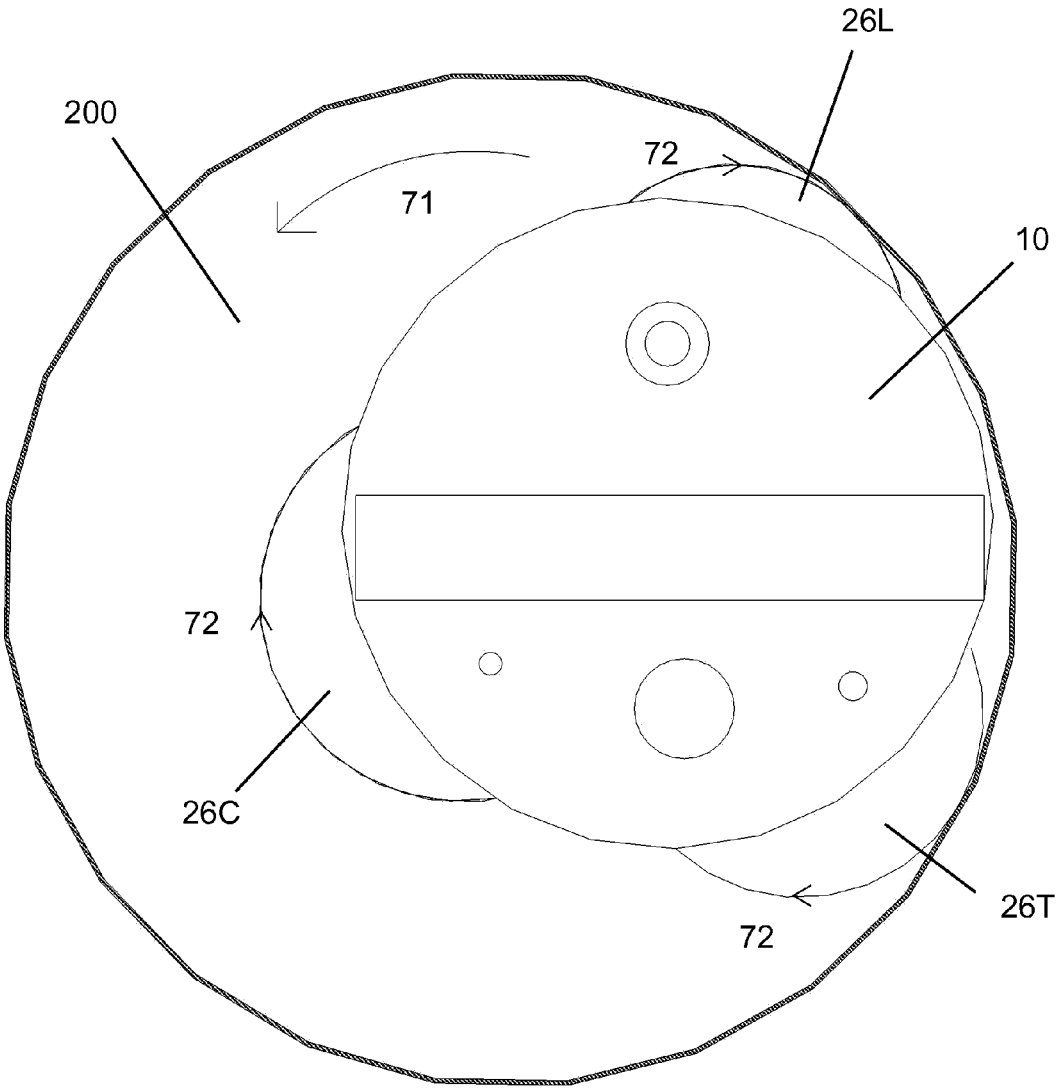
FIGS. 9A and 9B depict the motion vectors of an embodiment of a hands-free pot scrubber.

As depicted in FIG. 9A, this embodiment of a hands-free pot scrubber 10 will propel itself, due to the rotary motions 72 of the scrub brushes 26, in a substantially circular path 71 across the surface of the cooking utensil 200 that is being cleaned, due in part to the asymmetrical and non-parallel dispositions of the drive rods 24. The rotary motions 72 are clockwise and the circular path 71 is counterclockwise when, as depicted in FIG. 9, viewed from above. One skilled in the art will recognize, however, that counterclockwise rotary motions 72 will work as well, and will induce a hands-free pot scrubber 10 to move in a clockwise circular path 71.

The movement of this embodiment of the hands-free pot scrubber 10 is self-correcting, i.e., it will always align itself so that its direction of motion relative to the surface of the cooking utensil is with the lead scrubber 26L in the front and the trailing scrubber 26T trailing. Typically, when a hands-free pot scrubber 10 is operated to clean a circular cooking utensil 200, the center scrub brush 26C cleans a center portion, and the lead scrubber 26L and trailing scrubber 26T clean an outer portion, of the surface of the cooking utensil 200. The petals 28 (FIGS. 3 and 5) of the trailing scrubber 26T also clean the side wall of the cooking utensil 200, and may be made to be flexible to accommodate the varying side wall angles that will be encountered with different cooking utensils. Thus, substantially any initial orientation of a hands-free pot scrubber 10 relative to the cooking utensil will result in the pot scrubber moving over (and thus cleaning) every portion of the interior surface of the cooking utensil.

The invention thus addresses the problems of operating a device for cleaning cooking utensils without hand-guiding the device in its operation and permits an operator to attend to other activities during its operation.

One skilled in the art will recognize that other dispositions or arrangements of the drive rods 24 and thus scrub brushes 26 may also be used to cause a hands-free pot scrubber 10 to self-propel across the surface of the cooking utensil and that the pattern of motion of the hands-free pot scrubber 10 may be other than substantially circular. The components of a hands-free pot scrubber 10 may be made of any suitable material or combination of materials, such as metal, plastic or nylon. The scrub brushes 26 may be made of any suitable scrubbing or scouring material or combination of materials, e.g., steel wool, or nylon brush or pad.

An alternate embodiment of the hands-free pot scrubber 10 includes a shut-off timer (not shown) coupled to the switch 23 that operates to shut off the motor 20 after a pre-determined or selectable time duration (e.g., 1, 2, 3, 4, or 5 minutes) in order to prevent the hands-free pot scrubber 10 from operating for too long a time period. This shut-off feature would be useful, for example, in the event that the operator fails to manually shut off the operation of the hands-free port scrubber 10.

The required weight of a hands-free pot scrubber 10 varies depending upon the type of surface to be cleaned. For example, a weight of approximately 2½ pounds is generally sufficient for cleaning a non-stick surface such as Teflon, while a weight of approximately at least 5½ pounds is typically required for cleaning surfaces that stick like stainless steel and cast iron. A hands-free pot scrubber 10 may include a component (not shown) for increasing its total weight, e.g., one or more water (or other liquid) reservoirs, or detachable metal weights. Adjustment of the total weight permits a user to configure a hands-free pot scrubber 10 according to the particular characteristics of the utensils that require cleaning. In one embodiment of the hands-free pot scrubber 10, the weight distribution of its components is substantially symmetrical about the central axis 19. In an alternate embodiment, the weight distribution increases with radial distance from the central axis 19.

Figure 9B:
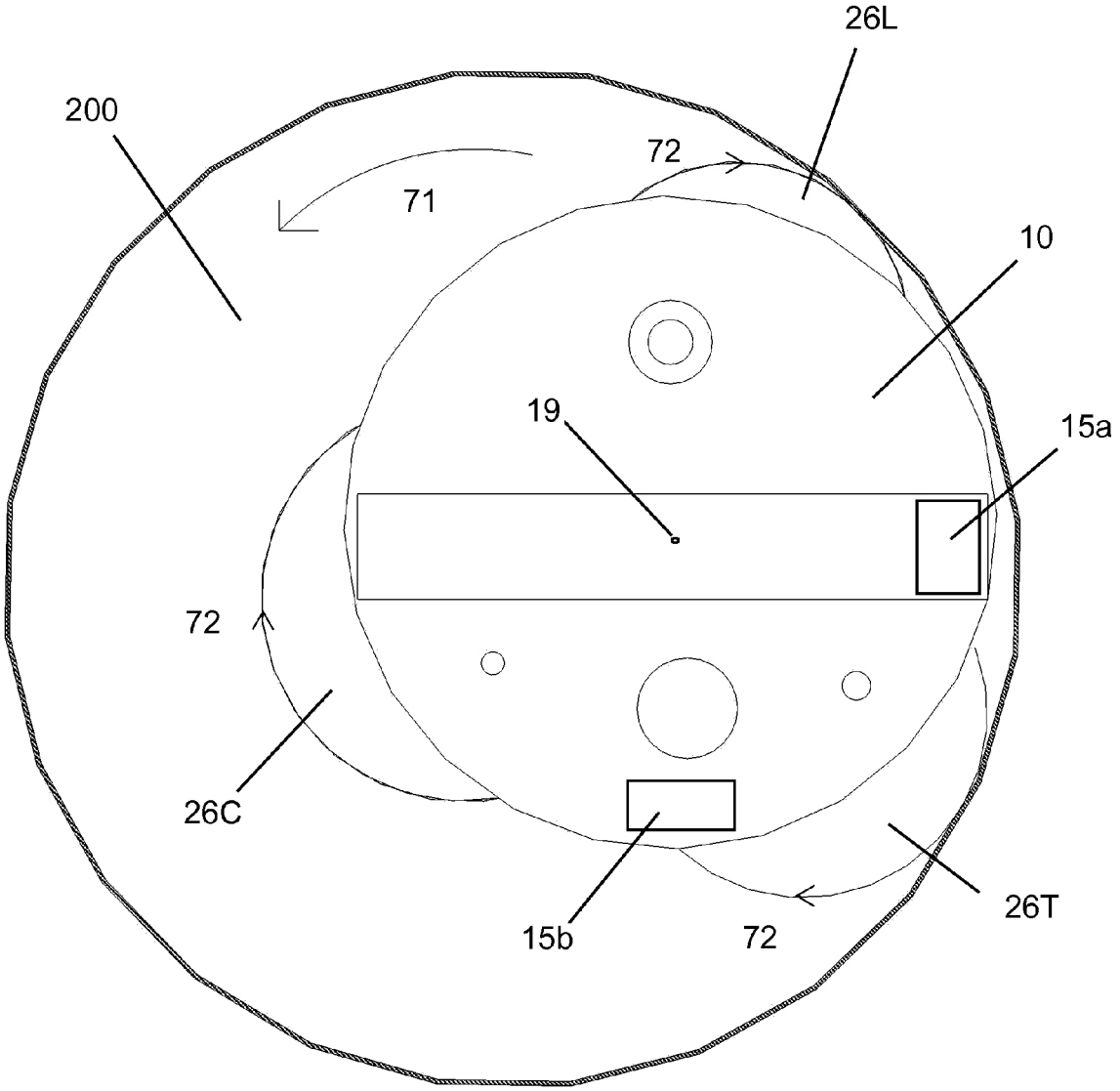

In some embodiments of a hands-free device 10, the center of mass of the hands-free device 10 does not lie along said central axis 19, due to an uneven distribution of mass. An example of this is depicted in FIG. 9B, in which a hands-free device 10 comprises weight components 15*a* and 15*b*, positioned in such a way so that the mass of the hands-free device 10 is distributed unevenly about the central axis 19, thereby resulting in a center of mass of the hands-free device 10 that does not lie along the central axis 19. In some embodiments, a weight component 15 may have a mass in the range of 1 to 50 ounces. Each weight component 15 may or may not be equal, equivalent or similar in mass, size, shape and composition. Other embodiments may use weight components 15 in other mass ranges, and the selection of the mass of a weight component 15 may depend upon factors such as the total weight of the hands-free device 10, the size, material and composition of the scrub brushes 26, and the power capability of the batteries 22 and motor 20. In the embodiment depicted in FIG. 9B, weight component 15*a* is disposed on the handle 12 and weight component 15*b* is disposed on the top section 34. One skilled in the art will recognize that a weight component 15 may be attached to, incorporated with, disposed upon, or integral to, one more components of a hands-free device 10, including the housing 30, handle 12, base section 32, top section 34 or other suitable component such that the mass of the hands-free device 10 is distributed unevenly about the central axis 19 and causing the center of mass of the hands-free device 10 not to lie along the center axis.

In some embodiments of a hands-free device 10, one or more of the weight components 15 may be adjustable in mass or detachable from the hands-free device 10, in order to allow a user to determine the extent of unevenness in distribution of mass of the hands-free device 10, thereby controlling the speed at which the hands-free device 10 propels itself a surface, An uneven distribution of the mass of a hands-free device 10 results in the portion of the weight of the hands-free device 10 borne by each scrub brush 26 to be unequal, i.e., at least two scrub brushes 26 each bear an unequal portion of the weight. In the embodiment depicted in FIG. 9B, the position of weight components 15*a* and 15*b* result in trailing scrub brush 26T bearing a greater portion of the weight of the hands-free pot scrubber 10 than is borne by either center scrub brush 26C or lead scrub brush 26L.

The unequal portion of the weight of the hands-free device 10 borne by each scrub brush 26 results in the hands-free pot device propelling itself across and cleaning the surface upon which it is operating.

In some embodiments, an uneven distribution of the mass of a hands-free device 10 results in a first side or edge of a scrub brush 26 bearing more of the weight of the hands-free device 10 than a second opposing side or edge of the same scrub brush 26. This causes the first side or edge to be more compressed than the second side or edge, resulting in greater traction between the surface and the first side or edge than the surface and the second side or edge, thereby causing the hands-free device 10 to propel itself.

Thus, several features of a hands-free device 10 have been described that cause a hands-free device 10 to propel itself across and clean the surface upon which it is operating. These features include at least the following: (a) a non-zero angle between at least two scrub brushes 26, (b) uneven mass distribution, (c) unequal lengths of at least two drive members 24, (d) any arrangement of the components of a hands-free pot scrubber 10 that results in a center of mass that is not aligned with a center axis 19, (e) any arrangement of the components of a hands-free device 10 that results in unequal portions of the weight borne by at least two scrub brushes 26, (f) any arrangement of the components of a hands-free device 10 that results in a tilt of the hands-free device 10 when it is on a horizontal surface, and (g) any arrangement of the components of a hands-free device 10 that causes one side or edge of scrub brush 26 to be more compressed than another side or edge when the hands-free device 10 is on a surface. An embodiment of a hands-free device 10 may include only one of these features, or any combination of these features, in order to obtain the ability to self-propel itself.

A hands-free pot scrubber 10 may be portable, so that it may easily be carried to a convenient location for use, e.g., sink, stove or countertop. One skilled in the art will recognize that a hands-free pot scrubber 10 may alternatively be constrained in a substantially fixed configuration, e.g., mounted next to a sink with a limited degree of movement sufficient to facilitate use at that location.

Figure 10:
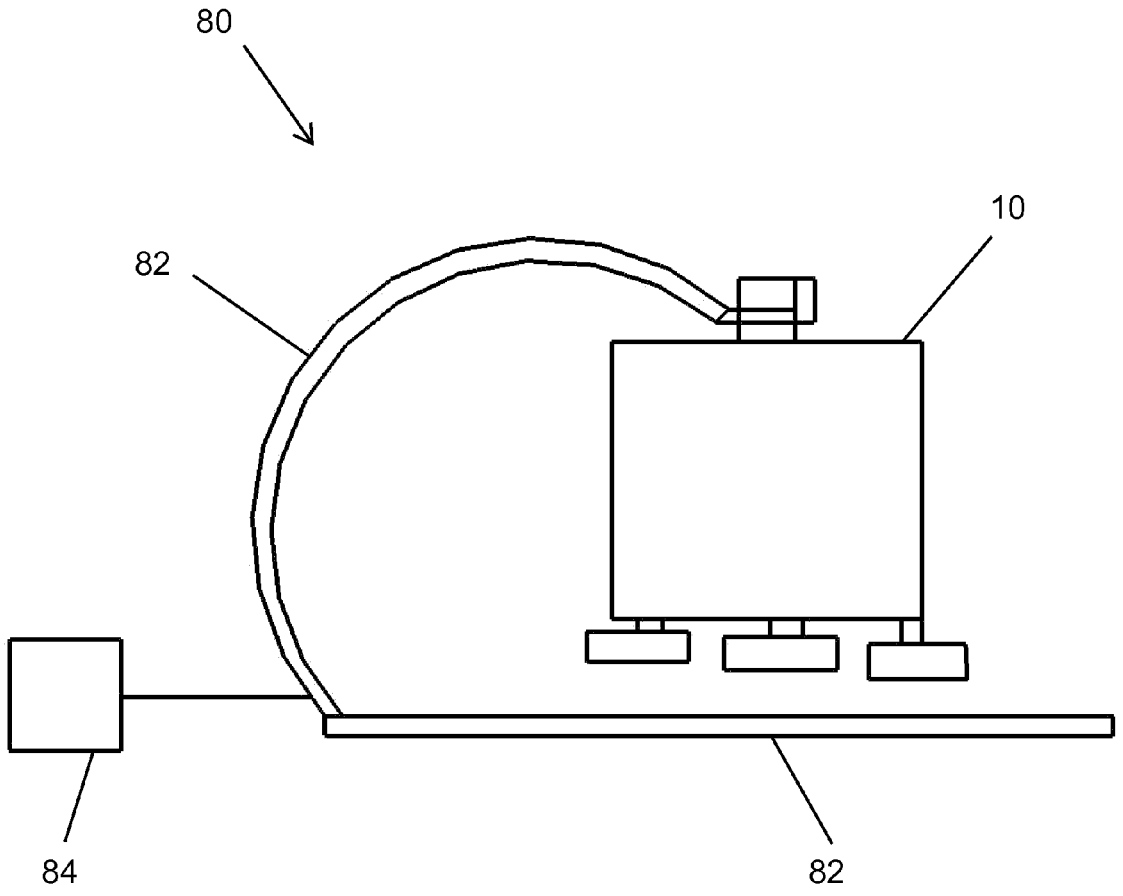
FIGS. 10 and 11 depict a side view and front view, respectively, of an embodiment of a hands-free pot scrubber connected to a charging station.
Figure 11:
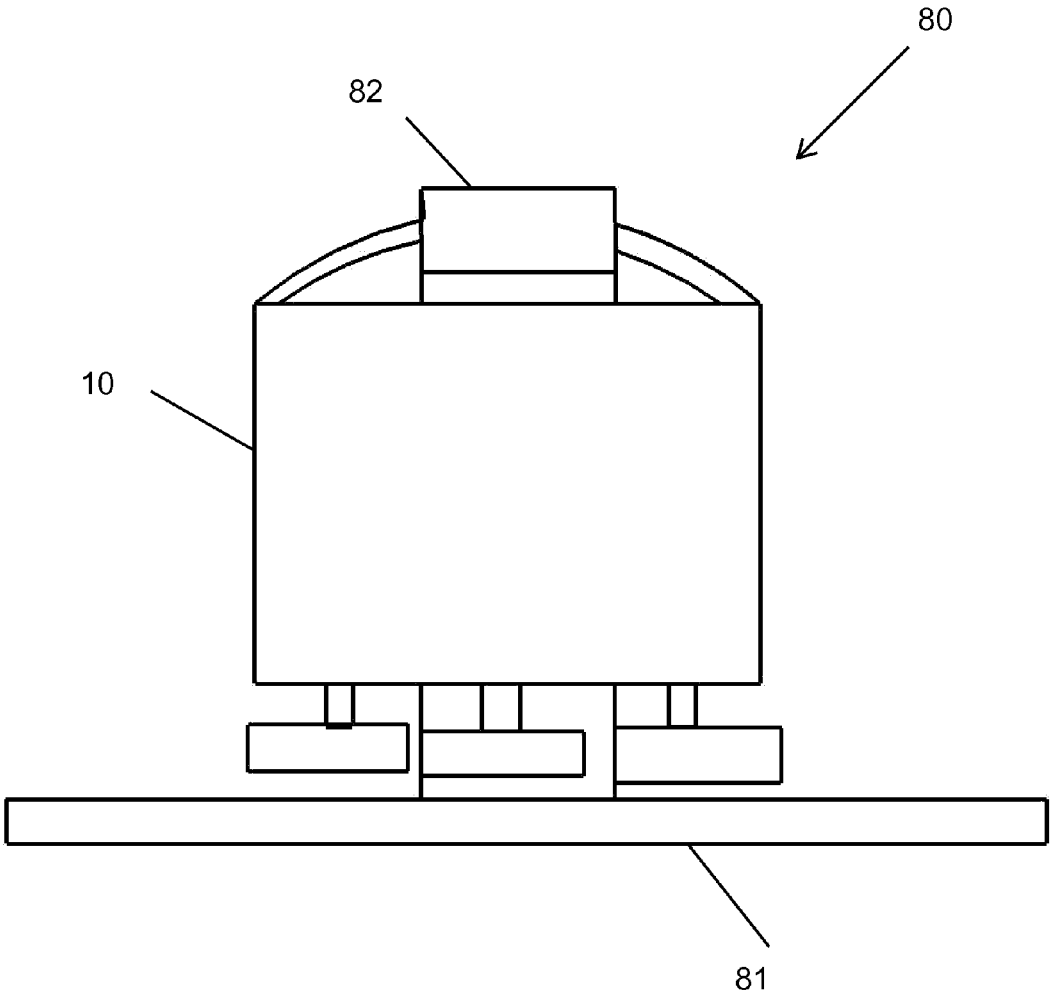
Figure 12:
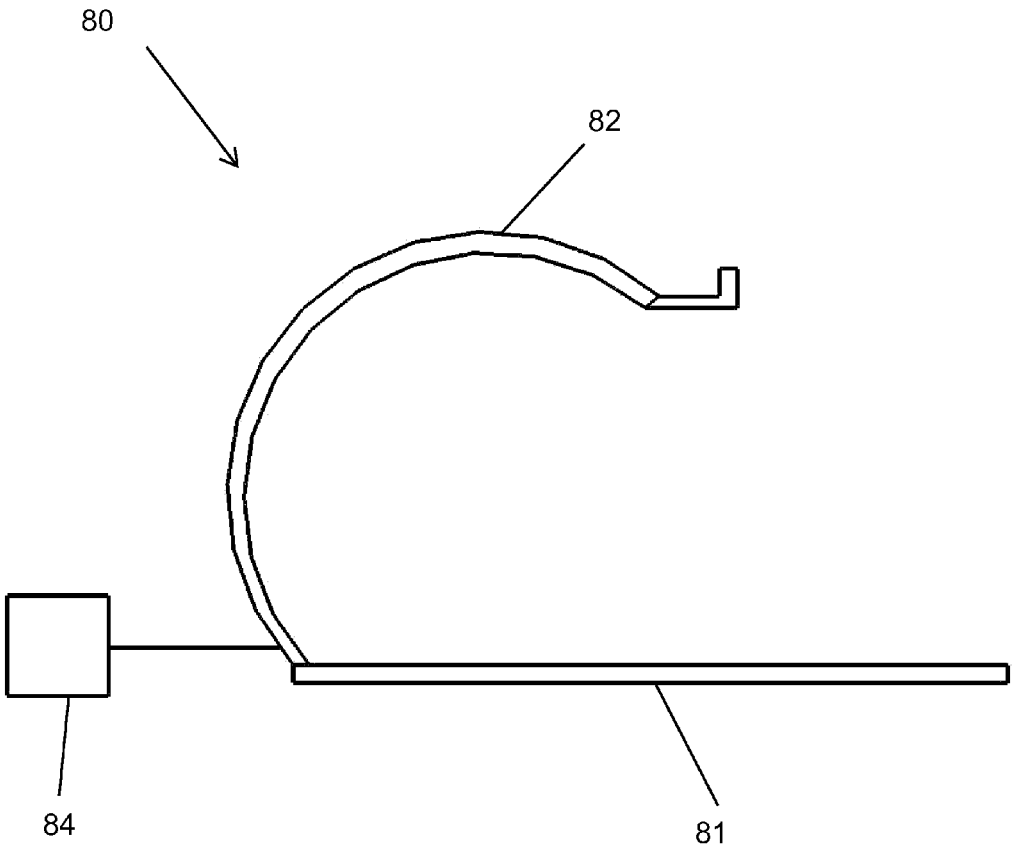
FIGS. 12 and 13 depict a side view and top view, respectively, of the charging station of FIG. 9.
Figure 13:
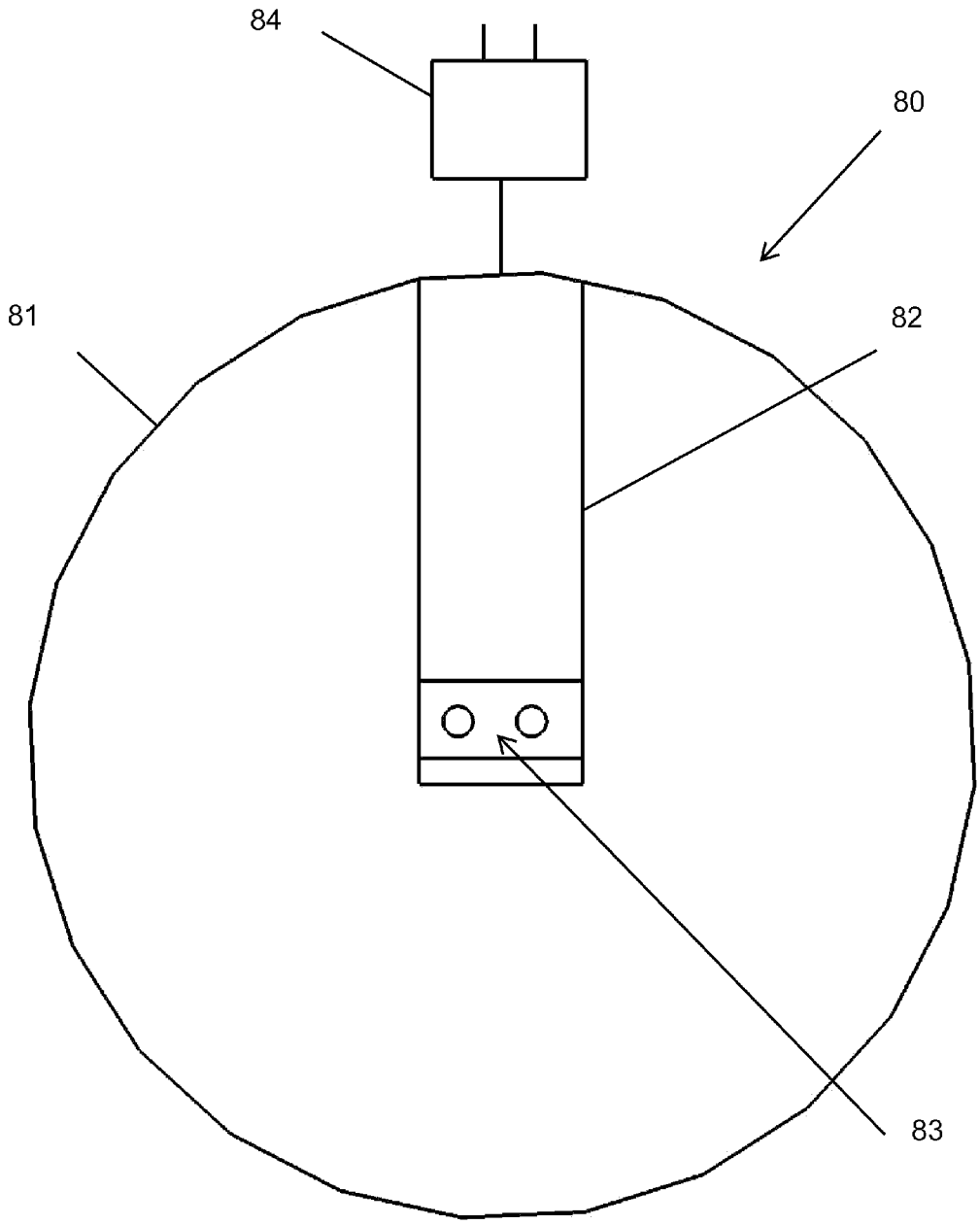

A hands-free pot scrubber 10 may be used in conjunction with a charging stand 80, as depicted in FIGS. 10-11. A charging stand, depicted alone in FIGS. 12-13, may be comprised of a base 81, a supporting arm 82 comprising two or more electrical charging contacts 83, and an electrical plug 84 electrically coupled to the electrical charging contacts 83 for supplying electrical power to the charging contacts 83 when plugged into an electrical outlet (not shown). The handle 12 of the hands-free pot scrubber 10 may have two or more electrical contacts (not shown), which, when the pot scrubber 10 is mounted on the supporting arm 82 of the charging stand 80, mate and make contact with charging contacts 83 for recharging the batteries 22 of the pot scrubber 10.

Figure 14:
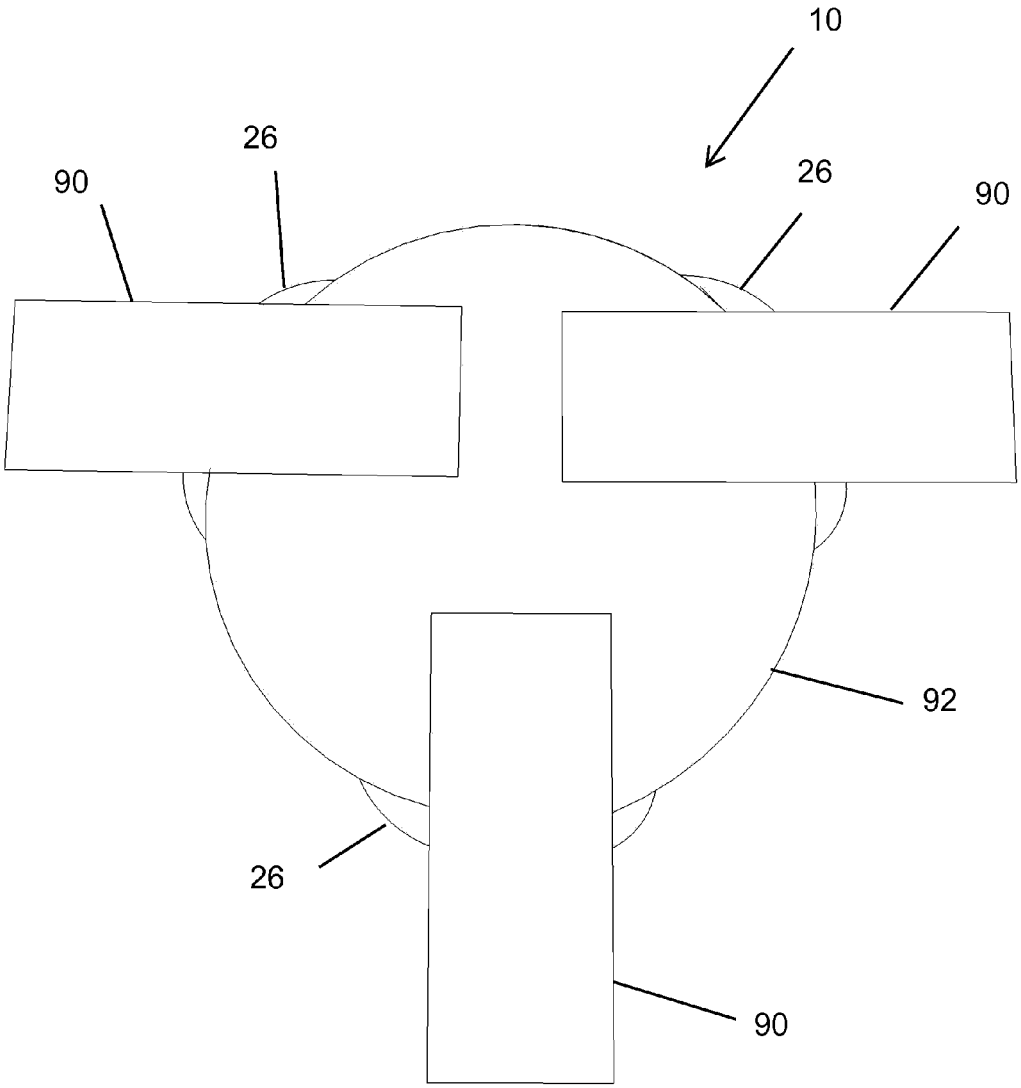
FIGS. 14-16 depict a top, side, and bottom view, respectively, of a second embodiment of a hands-free pot scrubber in accordance with principles of the present invention.
Figure 15:
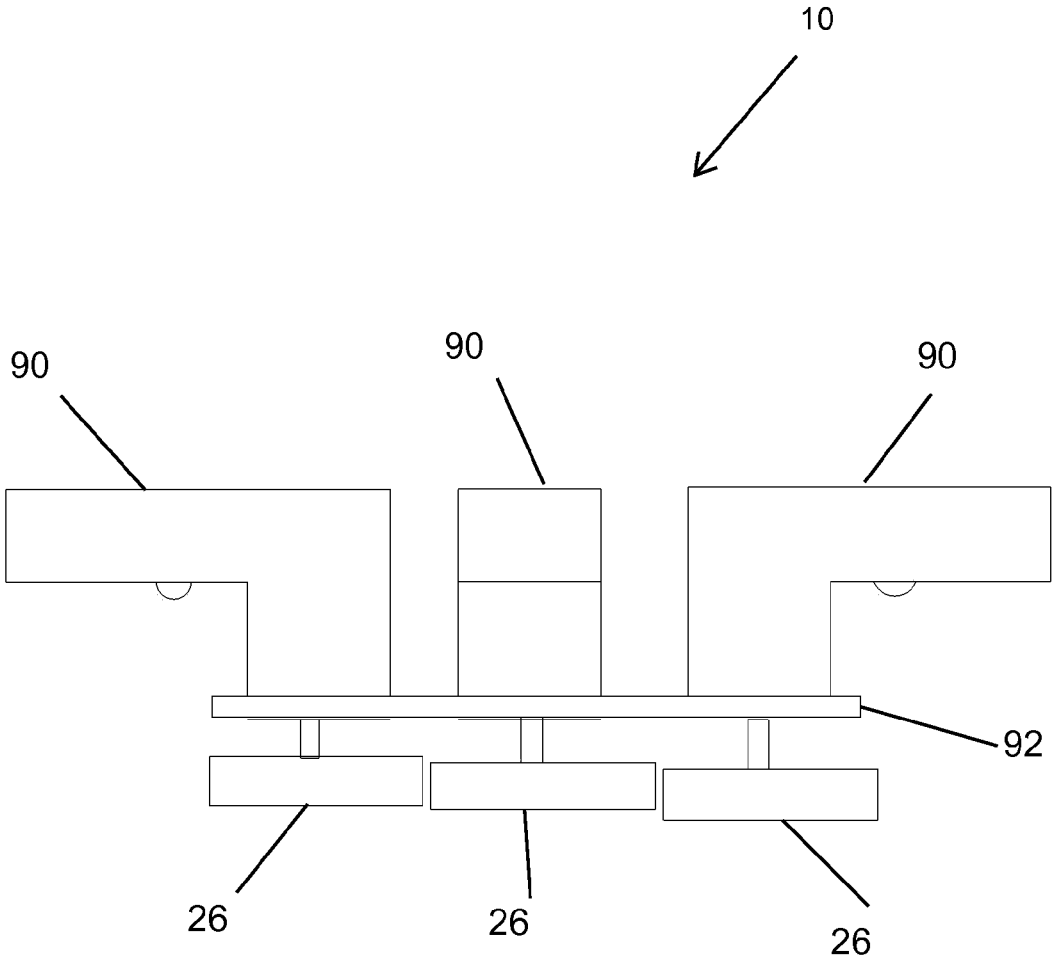
Figure 16:
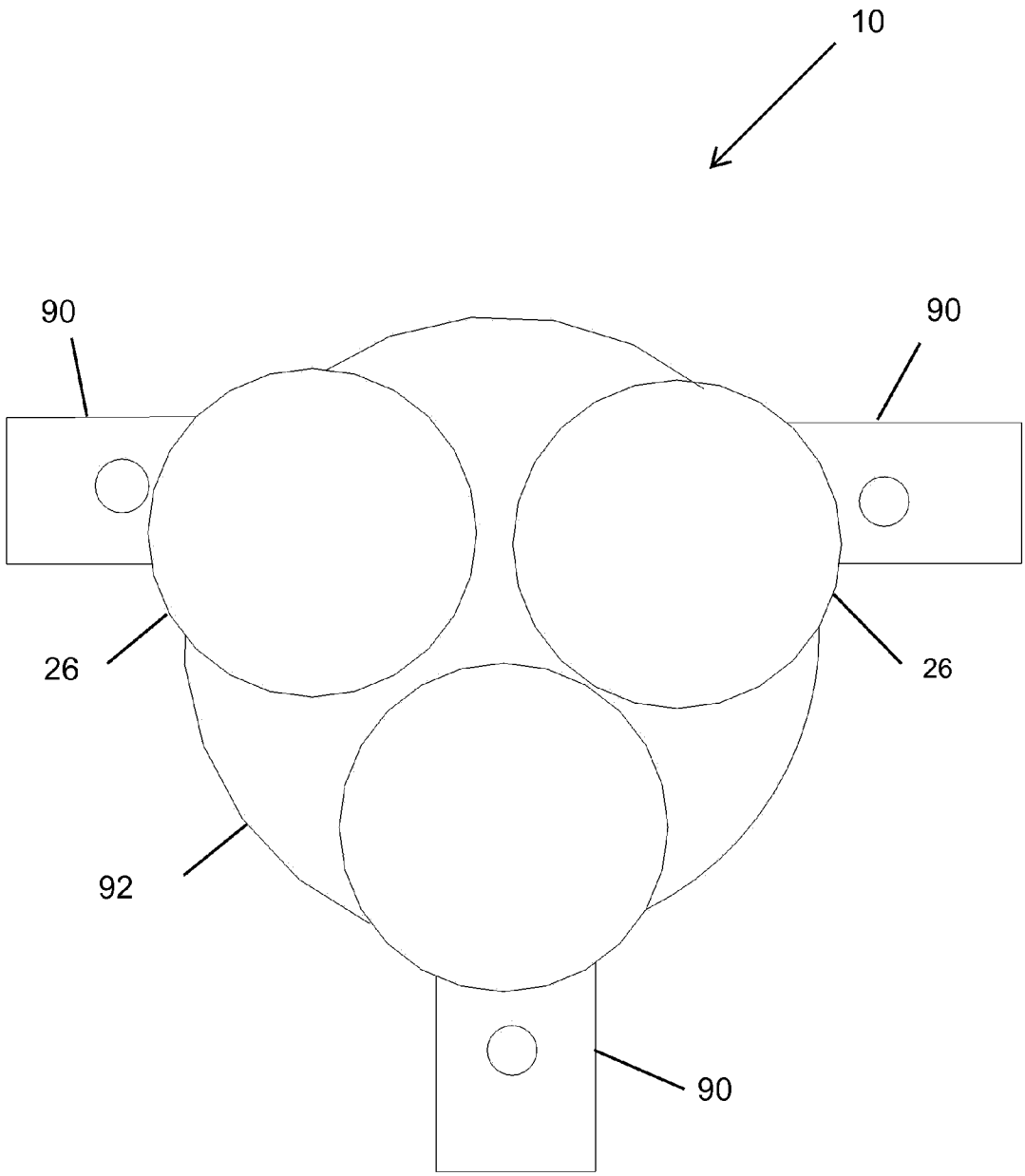

An alternate embodiment of a hands-free pot scrubber 10, depicted in FIGS. 14-16, comprises three detachable hand-held scrubbers 90 and an attachment piece 92 to which each hand-held scrubber 90 may be attached and detached. Each hand-held scrubber 90 has a housing that contains a motor and one or batteries electrically coupled to the motor for supplying electrical power to the motor, and a scrub brush 26 mechanically coupled to the motor.

Each hand-held scrubber 90, when not attached to the attachment piece 92, may be used as a portable hand-held scrubber to clean a cooking utensil. When the three hand-held scrubbers 90 are attached to the attachment piece 92 to form a hands-free pot scrubber 10, the formed hands-free pot scrubber 10 can be used in a manner similar to that described previously for the hands-free pot scrubber 10, and will self-propel itself over, and clean, the surface of a cooking utensil in a similar manner.

Figure 17:
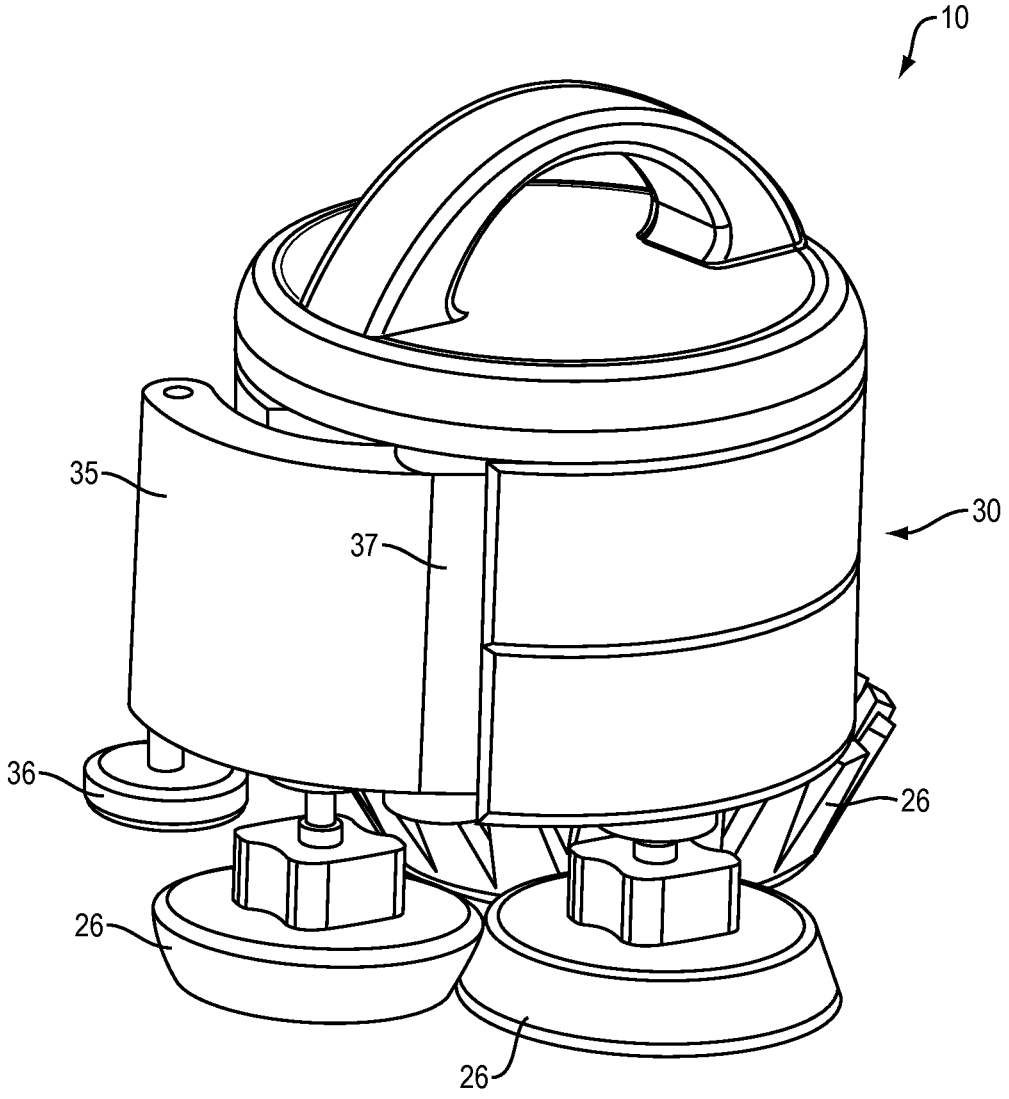
FIG. 17 depicts a perspective view of a third embodiment of a hands-free device in accordance with principles of the present invention.
Figure 18:
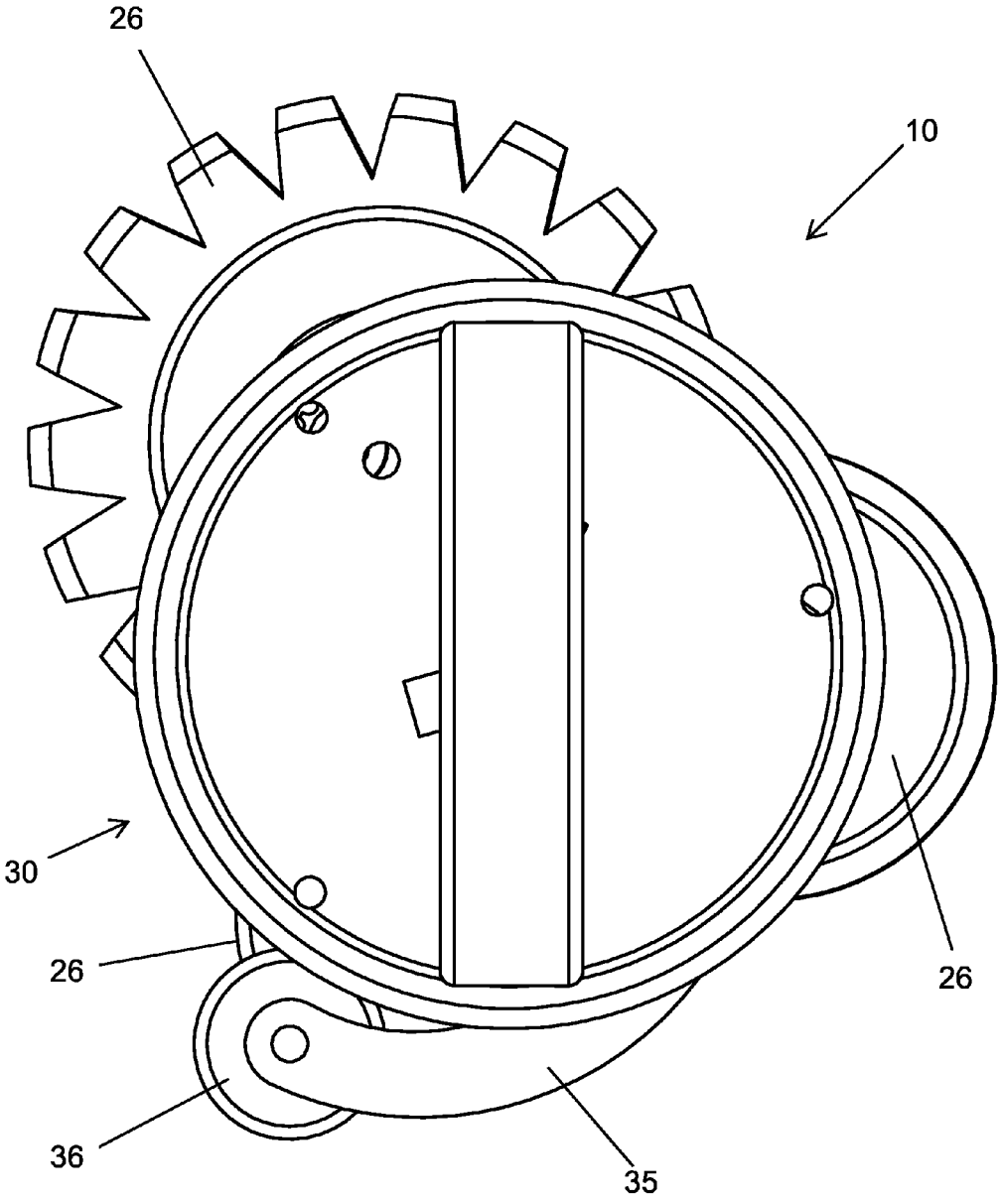
FIG. 18 depicts a top view of the hands-free device depicted in FIG. 17.

FIGS. 17-18 depict an alternate embodiment of a hands-free device 10 that includes a hinged portion 35 mechanically coupled to the housing 30 by a hinge 37. A passive, unpowered wheel 36 is rotationally coupled to the hinged portion 35 and disposed higher than the scrub brushes 26, so that the wheel 36 does not contact the bottom cooking surface of a cooking utensil when the hands-free device 10 is placed upon it. A spring (not shown) attached to the hinged portion 35 and either the housing 30 or hinge 37 urges or forces the hinged portion 35 away from the housing 30. This forcing of the hinged portion 35 results in the wheel 36 contacting a sidewall of the cooking utensil, and once this occurs the scrub brush 26 opposite to the wheel is forced against the opposing section of sidewall of the cooking utensil. Because of this, the scrub brush 26 that is so forced against the sidewall of the cooking utensil self-propels the hands-free device 10 around the pan and cleans the sidewall of the cooking utensil as well as its surface. Thus, the hinged portion 35 provides for improved accommodation of cooking utensils and surfaces of different sizes and results in greater traction on both sides of the utensil or surface and causes the hands-free device 10 to propel itself across and clean the surface upon which it is operating.

In yet other embodiments, a wheel 36 is mechanically coupled to a motor (not shown) by a belt (not shown) and pulley (not shown) or other suitable mechanism such that the wheel 36 that is rotationally coupled to the hinged portion 35 is powered, rather than merely being a passive component.

In some embodiments of a hands-free device 10 a ratchet mechanism (not shown) is used with or incorporated with the hinge 37 and a spring is not used. Such a ratchet mechanism allows the hinged portion 35 to be manually positioned outward (i.e., away from the housing 30) by a user in a locked position where the wheel 36 is forced against the sidewall, but prevents the hinged portion 35 from moving inwards, thus keeping the wheel 36 forced against the sidewall once so positioned. The ratchet mechanism includes a release mechanism (not shown) that allows a user to release the ratchet mechanism from its locked position.

One skilled in the art will recognize that multiple hinges 37 could be used to mechanically couple the hinged portion 35 to the housing 30, and that multiple springs could be used as well. Furthermore, multiple wheels 36 could be rotationally coupled to the hinged portion 35.

Figure 19:
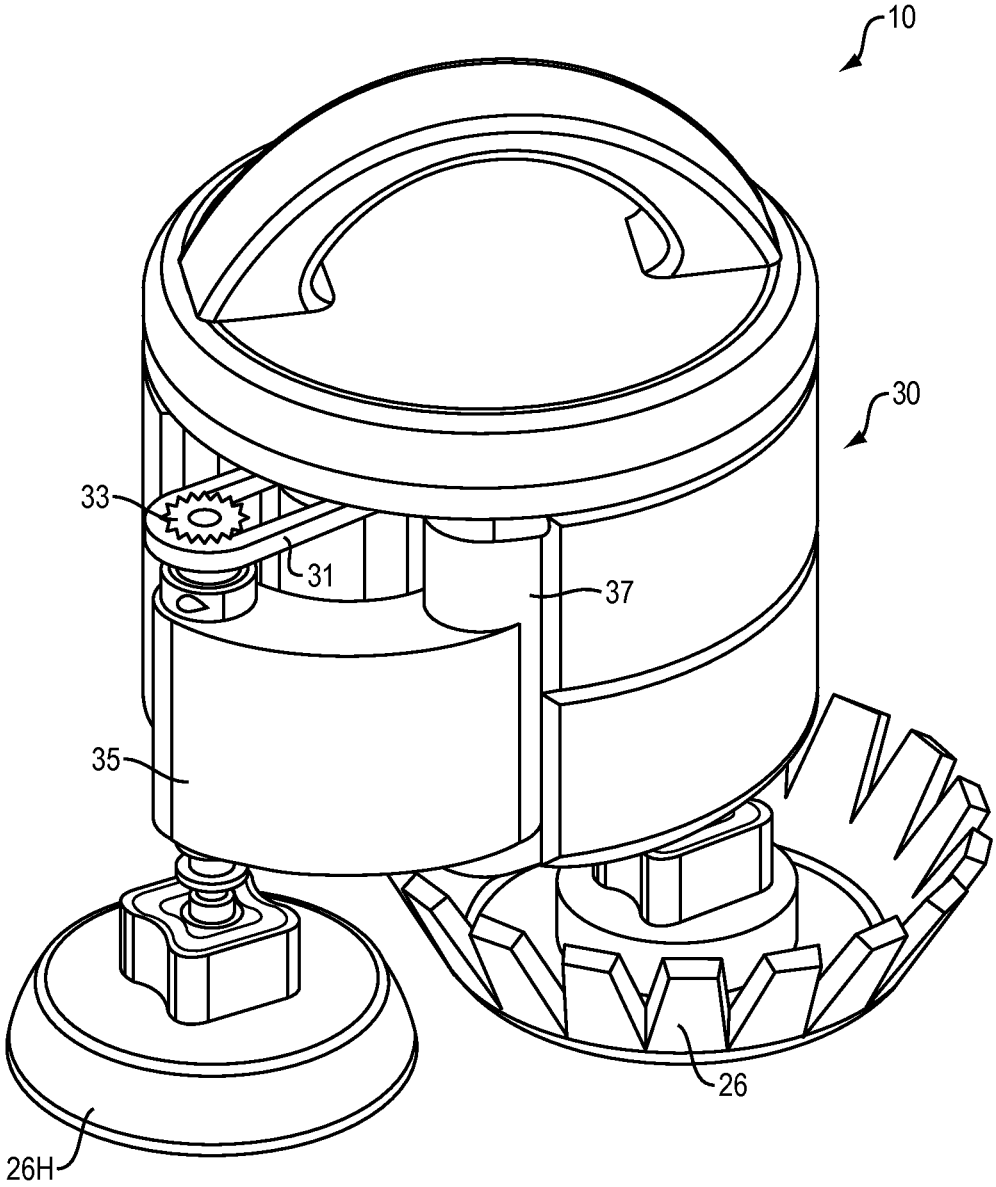
FIG. 19 depicts a perspective view of a fourth embodiment of a hands-free device in accordance with principles of the present invention.
Figure 20:
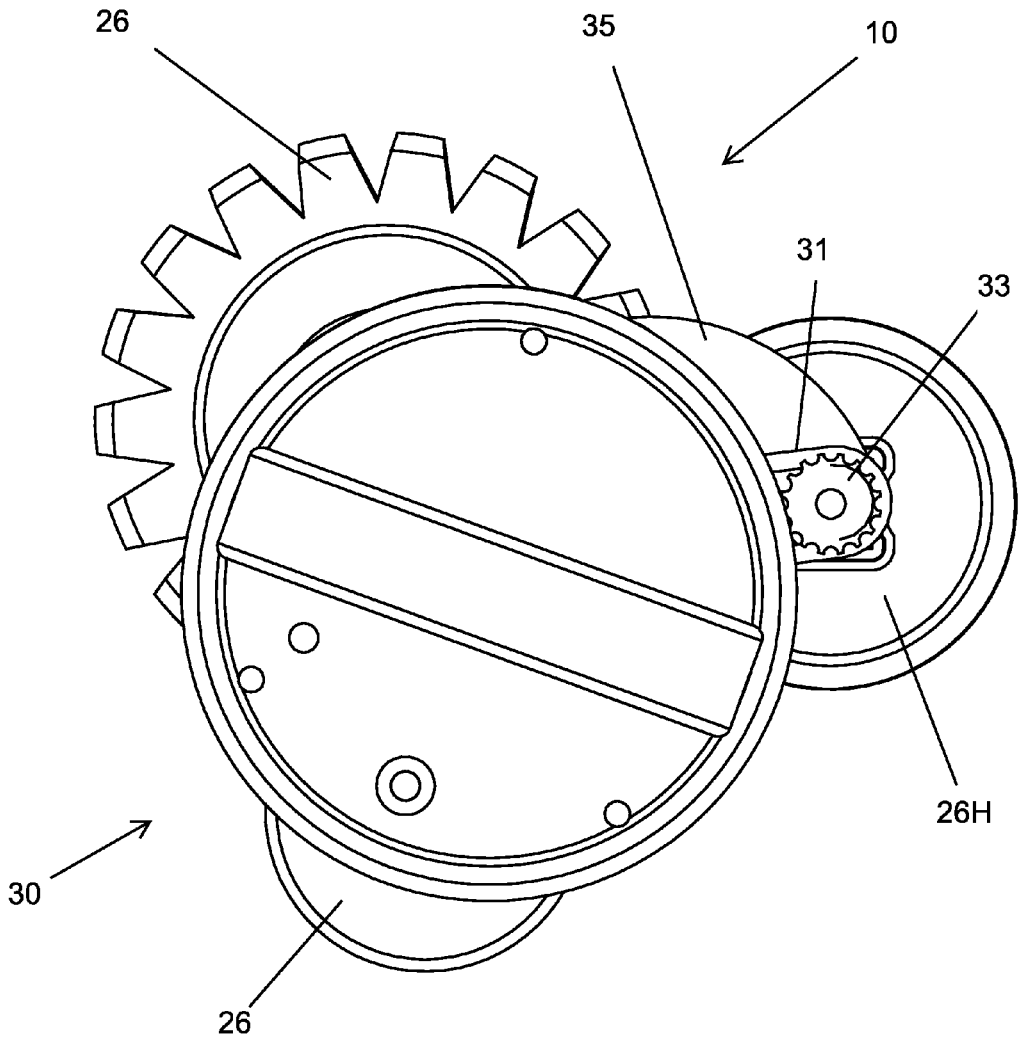
FIG. 20 depicts a top view of the hands-free device depicted in FIG. 19.

In some embodiments, an example of which is depicted in FIGS. 19-20, a scrub brush 26H is used in place of a wheel 36. In yet other embodiments, such a scrub brush 26H is mechanically coupled to a motor (not shown) by a belt 31 and pulley 33 or other suitable mechanism such that the scrub brush 26H that is rotationally coupled to the hinged portion 35 is powered, rather than merely being a passive component.

One skilled in the art will recognize that an assembly other than a housing 30 may be used to structurally contain and/or support the other components (e.g., the motor, batteries, drive members) of a hands-free device 10.

One skilled in the art will recognize that an arrangement of adjustable components other than a hinged portion attached by a hinge to a housing may be used to position the scrub brush 26H or wheel 36 such that is forced against a sidewall of the utensil.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention. This disclosure is intended to cover any adaptations or variations of the embodiments discussed herein.

What is claimed is:

1. A hands-free portable device for cleaning a substantially horizontal surface, the device comprising:

one or more motors substantially enclosed by a housing, wherein said housing does not engage said surface when said device is positioned upon said surface and not held by a user, two or more scrub brushes, each rotationally coupled to one or more of said motors, wherein at least one of said scrub brushes is disposed so that a side of said at least one scrub brush extends in a horizontal direction beyond said housing, wherein the distribution of mass of said device is substantially uneven, and wherein motion from said motors is rotationally transferred to said scrub brushes, said transferred motion and said substantially uneven distribution of mass of said device causing said device to be self-propelled on said surface, without the user hand-guiding the device.

2. The hands-free portable device of claim 1, the device having portions of weight borne by each of said scrub brushes, wherein said portions of weight are substantially unequal when said device is placed upon said surface and not held by the user.

3. The hands-free portable device of claim 1, wherein a first side of at least one of said scrub brushes bears more of the weight of the device than a second opposing side of said at least one scrub brush when said device is placed upon said surface and not held by the user.

4. The hands-free portable device of claim 1, said device having a central axis disposed substantially in the center of said device and aligned substantially vertically when said device is placed upon said surface and not held by the user, wherein the center of mass of said device does not lie along said central axis.

5. The hands-free portable device of claim 1, said device having a central axis disposed substantially in the center of said device and aligned substantially at a non-zero angle with vertical when said device is placed upon said surface and not held by the user.

6. The hands-free portable device of claim 1, wherein said device is tilted when it is on said surface.

7. The hands-free portable device of claim 1, further comprising one or more weight components positioned to provide said substantially uneven distribution of mass.

8. The hands-free portable device of claim 7, wherein the mass of each of said weight components is between 1 and 50 ounces.

9. The hands-free portable device of claim 7, wherein at least one of said weight components is integral to a component of said device.

10. The hands-free portable device of claim 7, wherein at least one of said weight components is either adjustable or is detachable from said device.

11. A hands-free portable device for cleaning a substantially horizontal surface, the device comprising:

one or more motors substantially enclosed by a housing, wherein said housing does not engage said surface when said device is positioned upon said surface and not held by a user, two or more scrub brushes, each rotationally coupled to one or more of said motors, wherein the distribution of mass of said device is substantially uneven, and wherein motion from said motors is rotationally transferred to said scrub brushes, said transferred motion and said substantially uneven distribution of mass of said device causing said device to be self-propelled on said surface, without the user hand-guiding the device.

* * * * *